US010032586B2

(12) United States Patent
Bayer

(10) Patent No.: US 10,032,586 B2
(45) Date of Patent: Jul. 24, 2018

(54) RELAY HAVING TWO ELECTRICALLY PARALLEL CONTACT SPRINGS

(71) Applicant: ZETTLER electronics GmbH, Puchheim (DE)

(72) Inventor: Richard Bayer, Berlin (DE)

(73) Assignee: ZETTLER ELECTRONICS GMBH, Puchheim (DE)

( * ) Notice: Subject to any disclaimer, the term of this patent is extended or adjusted under 35 U.S.C. 154(b) by 0 days.

(21) Appl. No.: 15/592,022

(22) Filed: May 10, 2017

(65) Prior Publication Data

US 2017/0250045 A1 Aug. 31, 2017

Related U.S. Application Data

(63) Continuation of application No. PCT/EP2015/076187, filed on Nov. 10, 2015.

(30) Foreign Application Priority Data

Nov. 10, 2014 (EP) ..... 14192577

(51) Int. Cl.

| | |
|---|---|
| ***H01H 7/16*** | (2006.01) |
| ***H01H 50/12*** | (2006.01) |
| ***H01H 50/08*** | (2006.01) |
| ***H01H 50/56*** | (2006.01) |
| ***H01H 50/60*** | (2006.01) |

(52) U.S. Cl.

CPC ..... *H01H 50/12* (2013.01); *H01H 50/08* (2013.01); *H01H 50/56* (2013.01); *H01H 50/60* (2013.01); *H01H 2205/002* (2013.01)

(58) Field of Classification Search

CPC ..... H01H 50/08; H01H 50/12; H01H 50/56; H01H 50/60; H01H 51/04; H01H 50/002

USPC ..... 335/156

See application file for complete search history.

(56) References Cited

U.S. PATENT DOCUMENTS 4,543,550 A * 9/1985 Sauer ..... H01H 51/2281 335/270
5,701,109 A * 12/1997 Poulsen ..... H01H 3/503 335/128
7,915,984 B2 * 3/2011 Niimi ..... H01H 51/065 335/126
7,948,338 B2 * 5/2011 Niimi ..... H01H 50/30 335/126

(Continued)

FOREIGN PATENT DOCUMENTS

DE 7323597 U 10/1973
DE 3843359 A1 7/1989

(Continued)

OTHER PUBLICATIONS

Hugel, Harold, "XP-002753364," Apr. 2002, p. 46.

*Primary Examiner* — Shawki S Ismail
*Assistant Examiner* — Lisa Homza
(74) *Attorney, Agent, or Firm* — Yakov S. Sidorin; Quarles & Brady LLP

(57) ABSTRACT

A relay with two current paths thermally connected in parallel is particularly fail-safe. In case of a failure of one main contact, the additional load current is led via the remaining functioning main contact. The failed main contact as well as the thermal connection between the two main contacts then serve as heat sinks, whereby the relay can continue to operate.

13 Claims, 7 Drawing Sheets

(56) References Cited

U.S. PATENT DOCUMENTS

| | | | | |
|---|---|---|---|---|
| 8,305,169 | B2 * | 11/2012 | Suzuki | F02N 11/087 335/126 |
| 9,007,156 | B2 * | 4/2015 | Hiraiwa | H01H 9/443 335/78 |
| 2012/0105179 | A1 * | 5/2012 | Kurasawa | H01H 51/065 335/185 |
| 2012/0319806 | A1 * | 12/2012 | Mills | H01H 50/12 335/185 |
| 2014/0062626 | A1 * | 3/2014 | Saito | H01H 51/04 335/185 |
| 2015/0015350 | A1 * | 1/2015 | Tachikawa | H01H 1/66 335/131 |
| 2015/0022292 | A1 * | 1/2015 | Tachikawa | H01H 50/54 335/131 |

FOREIGN PATENT DOCUMENTS

| | | | |
|---|---|---|---|
| DE | 102012222917 | A1 | 6/2014 |
| JP | H0272520 | A | 3/1990 |
| JP | H08264077 | A | 10/1996 |
| WO | 2008116432 | A1 | 2/2008 |

* cited by examiner

RELAY HAVING TWO ELECTRICALLY PARALLEL CONTACT SPRINGS

CROSS-REFERENCE TO RELATED APPLICATIONS

This application is a continuation of pending International Application No. PCT/EP2015/076187 filed on Nov. 10, 2015, which designates the United States and, in turn, claims priority from European Application No. 14192577.6 filed on Nov. 10, 2014.

BACKGROUND OF THE INVENTION

1. Field of the Invention

The invention relates to a method for switching a relay with two current paths connected in parallel, as well as to the relay for carrying out the method.

2. Description of Relevant Art

In the photovoltaic industry, inverters are normally used to convert the direct current supplied by photovoltaic modules on roofs into alternating current. These inverters have a DC voltage input, a DC voltage intermediate circuit and an output AC voltage side for feeding the electrical power generated by the photovoltaic modules into the electricity grid. In order to be able to safely connect and disconnect the inverters on the input side as well as on the output side, i.e. to galvanically separate them from the grid or the photovoltaic system (or, respectively, to reliably conduct currents during operation, mechanical isolating switches are used for generating a galvanic isolation path). The isolating switches are usually realized in the form of relays which are mounted in the inverters directly on the circuit boards. In general, inverters comprise a controller, which controls the level of the output-side voltage and/or the power provided to the grid by the inverter. The controller also controls the relays as well as all other tasks for the operation of the inverter, like a reduction of fed-in power on behalf of an energy supply company. If the switch is closed, a load current can flow; otherwise not. Relays are switches that are switched by means of an actuator, usually by switching on and off an electromagnet, which causes a contact of the switch to change between at least two switching states (e.g. switch open/switch closed).

For this purpose, relays have a first contact which is movable relative to a second contact. The first contact typically has an elastic metal strip which is with one end attached to a carrier, such that the other end is movable. The movable end carries a first contact piece for contacting an opposing second contact piece. The first contact piece and the second contact piece are pressed against one another when the contact is closed. The second contact piece is attached to a conductive metal rail. The metal rail may be a rigid profile or it may be a spring-elastic metal strip. Each of the metal rail and the elastic metal strip is commonly also referred to as a contact finger or contact spring. The first contact finger and the second contact finger form a main contact together with the respective contact pieces. The contact pieces can be formed by, for example, rivets or as contact surface(s) welded onto the contact fingers. The contact pieces may include conductive materials such as copper, aluminum or brass.

With the actuator, the first contact can be moved to contact the second contact or to be separated from it. Resetting the first contact finger into its initial position may be performed by means of an additional spring, or it may be performed solely via the spring elasticity of the contact finger and/or the actuator.

Usually, an electrically controllable drive element is used as an actuator. Relays often have an actuator configured as a linear motor that includes, for example, a coil and an armature movably associated with the coil. With the coil switched on, a force acts on the armature which moves the armature. The movable armature is generally coupled to the movable first contact pieces or the associated contact finger such that they are moved with a movement of the armature.

In high-current applications, such as e.g. the aforementioned inverter, relays often have two main contact pairs connected in parallel, each having a first movable contact and a second contact, for increasing failure-safety or ampacity. Each of the four contacts has a contact piece which is positioned opposite to a complementary contact piece. A common actuator acts on the two movable contacts.

SUMMARY

Relays are used in inverters in the fields of photovoltaics. A relay failure usually results in a failure of the entire system. This leads to a loss of profit as a result of the lack of supply.

The goal of the implementation of the idea of the invention is to reduce the probability of failure of relays with at least two main contacts connected in parallel, in the event of failure of one main contact and to enable continued operation of the entire system.

The idea of the invention is based on the realization that relays with two main contacts connected in parallel fail when the transition resistances between the two contact pairs are different due to external circumstances (or one of the two parallel current paths is disturbed in another way), e.g. because one of the main contacts has not been correctly contacted due to a mounting error or contamination, scaling, or any other defect. Due to the failure of one main contact, a current can only flow via the one remaining main contact. Therefore, a current which is higher than the specified current of the remaining main contact flows via the remaining main contact, i.e. its contact finger and contact pieces. In the following, the specified current is called and referred to as nominal current. Due to the increased current via the remaining main contact, the relay is warmed to such extent that thermal damage occurs to the relay or to parts of it.

The idea of the invention is to cool the remaining-operational main contact (or the plurality of such remaining-operational main contacts) such that it/they replace(s) the failed main contact or to make sure that the relay can be operated at least for some period of time. Due to such cooling, the ampacity (that is the nominal current which the at least one remaining main contact can carry) is increased without otherwise changing the at least one main contact that remains operational. For this purpose, the at least two main contacts are connected to each other in a thermally conductive manner. In other words, at least two of the main contacts are connected via a thermal conductor, e.g. via a thermal bridge. This renders the defective/failed main contact to act as the heat sink for the at least one remaining-operational main contact.

As soon as one of the at least two main contacts fails, the (total) load current is directed towards and conducted through the at least one main contact that remains operational. At least a part of the electrical power loss (released as heat at such remaining operational main contact) can be dissipated via at least one heat sink that is thermally-conductively connected to the remaining-operational main contact.

At least two main contacts are preferably connected to one another in a thermally conductive manner and/or can each of them be provided with a device configured to dissipate the heat generated at the contact pieces and the contact fingers, such that in the event of a failure the relay can reliably continue to operate.

The thermally conductive connection can be arranged on the same side of the chosen main contact as that carrying the first contact pieces. Likewise, an attachment of the thermally conductive connection (or member) on another (rear) side of the contact fingers is possible. In order to improve the thermally conductive connection, heat conducting paste can be applied between the contact fingers and the thermally conductive connection. The thermally conductive connection between the at least two movable first contacts can be realized by at least one metal strip which connect(s) the contact fingers and/or contact pieces. At the connection point, heat-conducting paste can be applied between the corresponding contact finger and the thermally-conductive connection.

Alternatively, the first contact fingers can also be realized with differently shaped thermal conductors also having electrical properties, e.g. by means of a suspended braid. The position of the thermal connection between the first contact of the first main contact and the first contact of the at least one other main contact is preferably at the level of or next to the contact pieces. As a result, the thermal resistance of such thermal connection or member is reduced due to shortening of a pathway available for dissipating the thermal power.

According to the embodiment of the invention, a method is specified for switching a load current with a relay with at least two main contacts electrically connected in parallel. The load current is the current flowing through the relay while the main contacts are closed, e.g. during normal operation of an inverter. Each of at least two main contacts electrically connected in parallel each has at least one movable first contact finger with a first contact piece on such finger. These form the so-called first contact. The contact fingers are attached to a carrier. Due to the attachment at the carrier, a second end of a finger is movable with respect to its first end. To close the load circuit, each of the first contact pieces is brought into abutment (preferably at least approximately synchronously) with a respective complementary second contact piece of the corresponding main contact. In order to (electrically) open a main contact again, the first contact piece is repositioned or removed from the second contact piece, i.e. the contact pieces are moved apart such that a spatial distance (galvanic separation distance) is established between them. Consequently, the load circuit is opened again and thus interrupted electrically.

The second contact may comprise a fixed inflexible carrier rail as a contact finger, which is attached at one end to the same carrier. The second contact piece is attached e.g. to a free end of the second contact finger. However, the second contact finger can also be designed to be flexible.

The contact fingers can include flexible sheet metal strips, which are mechanically resilient, or can also be designed as rigid elements. The sheet metal strips can include a plurality of interconnected layers such that an air gap is formed between the individual layers, which leads to an increase of the value of the spring-constant as well as to an improved cooling effect. The respective first and second contact piece together with carriers and/or contact fingers are also referred to as so-called main contacts.

The contact pieces may include conductive materials such as copper, aluminum, or brass. To improve the surface conductivity or corrosion protection, the contact pieces can also be provided with a surface coating, such as e.g. gold or silver coating. In order to improve various properties, the use of alloying metals (such as tungsten) is also considered, which leads to an improvement in the burn-off properties.

Preferably, the at least two main contacts are connected in a thermally conductive manner via a heat sink element configured to act as a thermal bridge, such that the defective main contact can be used as (second) heat sink for the at least one remaining-operational main contact. Alternatively or in addition, the thermally conductive bridge can include a plurality of heat sinks arranged parallel to one another. In the context of solids, materials with a specific thermal conductivity as from $$30\frac{W}{m\cdot K}$$

are referred to as thermally conductive. In addition, the first contact fingers may have passage openings (as well referred to as through-holes or apertures) in the region of the first contact pieces. Such passage openings are configured to improve the inflow behavior of the first contact fingers and thus lead to a better cooling of the first contact fingers and of the first contact pieces and thus to a better cooling of the relay in general. In one case, the thermally conductive connection or member can preferably directly connect the at least two first contact pieces. In this context, the term "directly" is to be understood as a connection in the shortest way, and without intermediate elements. For this purpose, the thermally conductive connection or member is preferably provided at the level of or next to the at least two first contact pieces, in order to keep the thermal transition resistance between the two first contact pieces as low as possible.

Preferably, the operation of at least one of the at least two main contacts is monitored. In the event of a main contact failure, the load current through the relay can be reduced, if desired, with a control unit such as e.g. an inverter or another device, and/or a fault message or, generally, output indicia of fault can be produced by the system. For monitoring purposes, for example, the temperature difference between temperatures of the two main contacts can be monitored. If this temperature difference is greater than a difference threshold value, the control can interpret this as a failure of one main contact. Alternatively, also the temperature of one of the two main contacts can be monitored for monitoring purposes. A failure is present if the temperature of one of the two main contacts exceeds a particular threshold value. The temperature measurement can be performed, inter alia, by means of temperature sensors such as PTC or NTC conductors, or in any other way. The temperature sensors can be arranged in the relay housing or on the outside of the relay or on the circuit board of e.g. the inverter, the circuit boards of which can also be used as cooling surfaces. Alternatively, a temperature sensor can be attached on each of the at least two pairs of contacts. For example, alternatively or additionally, the temperature of the supply line of the relay can also be determined. In practice, relays are often mounted on printed circuit boards, connecting lugs or soldering lugs for mounting of the relay are soldered or inserted into a socket provided on the circuit board. The connecting lugs can then be used for heat dissipation by additional heat sinks or cooling surfaces available on the circuit board. An alternative possibility for detecting a contact failure is to detect the voltage value via the at least two main contacts. The detection of voltage drop can also be performed via the connection lugs of the relay. If the voltage at at least one of the at least two contact fingers falls below or rises above a certain value, for example, the load current can also be reduced and/or output indicia of fault (such as a fault message) can be generated. Another alternative for monitoring the proper functioning is the detection of current flowing through the main contacts, e.g. by means of a built-in measuring resistor, an inductive transducer, or a Hall sensor. If the current through one of the main contacts or the difference between the levels of currents through the main contacts rises above or falls below a predetermined value, one of the aforementioned measures and responses can also be triggered, in order to ensure a safe continued operation of the relay. The evaluation of the measurement as well as the initiation of the mentioned measures/responses can be carried out by the control or regulation unit provided in the inverter of the system.

The described method serves for operating a relay for switching a load current. For this purpose, the relay is provided with at least two main contacts, which are to be operated while electrically connected in parallel, each of which main contact has a first movable contact finger. The electrical parallel circuiting can be established by a bridge between the main contacts in the relay or by an external electrically-conductive bridge (e.g. on the printed circuit board). Each of the first contact fingers of the relay carries at least one first contact piece, which in turn is arranged opposite at least one complementary second contact piece on a second contact finger of the same main contact. The respective first contact fingers or the first contact pieces can be operatively connected to at least one actuator in order to bring the first contact pieces (essentially synchronously with respect to each other) into contact with the correspondingly complementary second contact pieces. The load circuit is electrically closed by contacting the first and second contact pieces. If the contact pieces are spatially separated from one another, the load circuit is electrically opened. At least one of the first contact fingers is thermally conductively connected to at least one heat sink element in order to dissipate heat.

Preferably, at least two movable contact fingers of at least two main contacts are thermally-conductively connected to one another. This results in a particularly good cooling of the relay. The movable contact fingers generally have a smaller cross-sectional area than the static contact fingers. Therefore, the heat dissipation of the movable contact fingers via the connections of the relay is comparatively poor. This problem is addressed by thermally conductively coupling the movable contact fingers with one another.

The cross-section A of the thermally conductive connection or member preferably satisfies the condition of:

$$A \geq \frac{P_v l}{\Delta T \lambda}$$

where $P_V$ is the power loss of a main contact at its nominal current, l is the length of the thermally conductive connection between the main contacts, λ is the specific thermal conductivity of the thermally conductive connection, and ΔT is the maximum permissible temperature difference between the beginning and the end of the thermally conductive connection.

Since the at least two main contacts are electrically connected in parallel, the current flowing through them is split. In practice, however, this splitting is often uneven, such as e.g. 70:30 or 60:40. In nominal operation, on average the nominal current flows via each of the at least two main contacts.

The resulting power loss PV per main contact can be calculated in nominal operation, which corresponds to the operation without a defect, with the equation $P_V = R_K \cdot (I_N)^2 \cdot R_K$ designates the corresponding Ohmic resistance of the main contact and $I_N$ is the nominal current flowing through the respective main contact. The power loss generated in the contact finger can be neglected, since its value is negligible compared to the power loss at the contact point, i.e. as compared to the power loss occurring at the contact pieces. In the event of a contact failure of a main contact, at least one main contact that remains operational must carry the double nominal current. This results in twice the power loss at this main contact. In order to avoid inadmissible heating of the remaining-operational main contact, such additionally power loss is dissipated via the defective main contact and/or at least one heat sink attached to the still operable main contact in the region of or next to the contact pieces. To estimate the dissipation of heat via the thermally conductive connection or member, the equation $$\dot{Q} = \frac{A \lambda \Delta T}{l}$$

can be applied. $\dot{Q}$ represents the heat flow, A represents the surface of the heat conductor used for heat dissipation (such surface being perpendicular to the heat flow), λ represents the thermal conductivity of the heat conducting material, ΔT represents the temperature difference between the beginning and the end of the heat conductor, and l represents the length of the heat conductor in the direction of the second main contact. In order to keep the remaining functioning main contact below the maximum specified temperature (which is also called and referred to as the nominal temperature), the additional power loss is mainly dissipated via the heat conductor. The following approximation of the previous equation is valid:

$$(I_N)^2 \cdot R = P_V = \dot{Q} = \frac{A \lambda \Delta T}{l}$$

A prefactor can be taken into account when calculating the power loss to be dissipated, if each of the at least two main contacts is designed to accommodate a slightly higher value of current than the current flowing through the relay during normal operation. Alternatively, this would also be possible if a higher upper temperature limit of the main contacts than in normal operation is permissible. Accordingly, the full nominal power loss does not have to be dissipated.

In order to detect a contact error, the voltage or other measuring signal is tapped off and fed to a control or regulation unit of the inverter via the soldering lugs or via the main contacts or at a separate output. Subsequently, the control or regulation of the inverter can reduce the current through the relay to such an extent that this corresponds to the ampacity of a cooled main contact. In addition, the inverter is configured to report a fault message or generate other indicia of the defect of a relay to an operating center via an existing network connection or another communication link. This allows the user to replace the relay as quickly as possible prior to a total failure of the system.

Alternatively, a temperature sensor may be mounted in the relay housing or on one or all of the at least two contact fingers. In the event of a contact failure, a circuit responsible can reduce the load current through the relay and issue a fault message to an operating center.

A further advantageous embodiment is a method for operating an inverter with at least one of the described relays, which can be arranged on a circuit board. In addition, the inverter can comprise a control or regulation. Cooling elements or conductor track surfaces can also be arranged on the circuit board of the inverter. The conductor track surfaces can also be used as a heat sink. The relay can be directly soldered with conductor tracks which are used for connection and/or as a heat sink. Alternatively, it can be inserted or mounted on a mounting base for fixation and electrical contacting.

BRIEF DESCRIPTION OF THE DRAWINGS

In the following, the invention will be described by way of example, without limitation of the general inventive concept, on examples of embodiment and with reference to the drawings.

Figure 1:
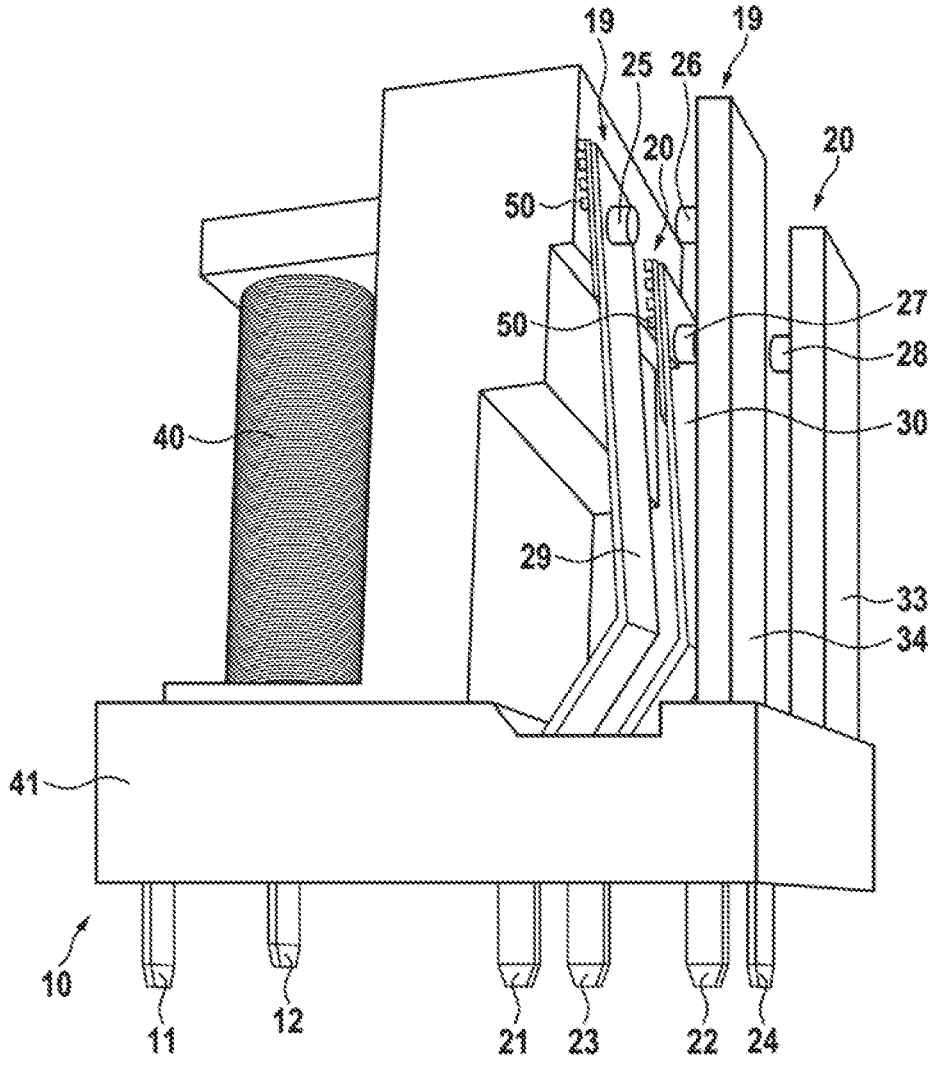
FIG. 1 shows a view of an embodiment of a relay.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

FIG. 1 shows a relay 10 in an oblique view. The relay 10 has a first main contact 19 and a second main contact 20 which can be electrically connected in parallel via a mounting base 41 or via a circuit board. Each of the main contacts 19, 20, respectively, is electrically connected to a first soldering lug 21, 23 as well as a second soldering lug 22, 24. The soldering lugs 21, 22, 23, 24 are arranged in the mounting base or carrier 41. The main contacts can be electrically contacted from the outside via the soldering lugs 21, 22, 23, 24. The first soldering lugs 21, 23 are each guided on a first contact finger 29, 30 and are electrically contacted with these. The first contact pieces 25, 27 of the first and second main contacts 19, 20 are attached to the upper end of the first contact fingers 29, 30. Lying opposite thereto, a respective second contact piece 26, 28 is attached at a first and a second conductive support rail 33, 34, as a counter contact to the corresponding first contact pieces 25, 27. With the main contact 19, 20 closed, the first contact pieces 25, 27 and the second contact pieces 26, 28 are pressed against each other and provide the electrical contact.

An actuator with a coil 40 and a movable armature (not shown) is on the carrier, which is in operative connection with the first contact fingers 29, 30 or with the first contact pieces 25, 27, in order to enable simultaneous movement of the contact fingers 29, 30 and the contact pieces 25, 27. The coil 40 is electrically contacted via a pair of coil connections 11, 12. When the coil 40 is energized, the contact springs 29, 30 are displaced in the direction of the support rails 33, 34 via a bracket (not shown) of the coil, which bracket is connected to the movable armature of the coil. The contact springs 29, 30 are thus brought into abutment with the second contact pieces 26, 28. By this, the load circuit is closed via the contact pieces 25, 26, 27, 28. A cooling plate 50 is arranged at the first contact finger 29 and the second contact finger 30, for the purpose of dissipating the additionally generated waste heat in the event of failure of one of the two main contacts 19, 20.

Figure 2:
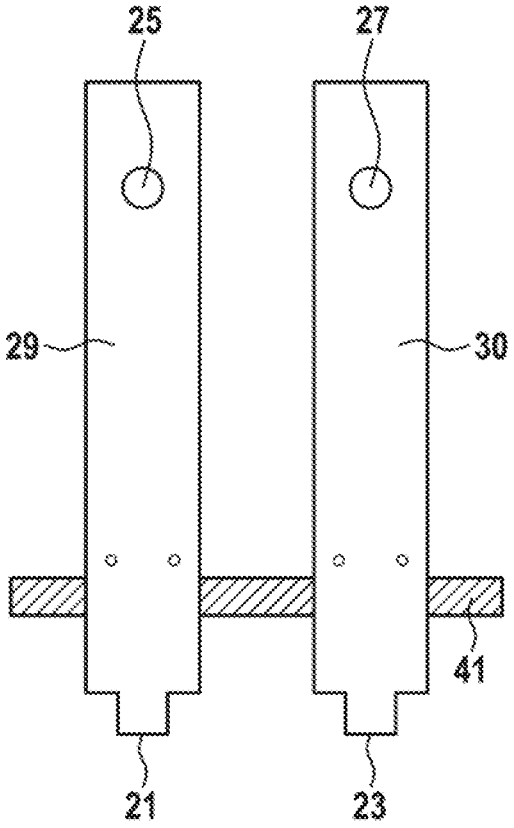
FIG. 2 shows a view of a partially assembled relay with two contact fingers and the corresponding contact pieces according to the prior art.

FIG. 2 shows a partially assembled relay with a carrier 41, on the bottom side of which connections (which are also called soldering lugs 21) for the relay are arranged. The two soldering lugs 21, 23 are respectively connected electrically conductive to one spring-elastic metal strip 25, 27 serving as a contact finger and can be connected in parallel on the connection side 21, 23.

A respective first contact piece 25, 27 of a pair of contacts is attached to the end regions of the contact fingers 29, 30 that face away from the connection (the end(s), for short). An actuator (not shown) acts on the contact fingers 29, 30 to move the contact fingers 29, 30, respectively, in the direction of a complementary second contact (not shown) of the corresponding pair of contacts and/or to open the pairs of contacts.

The second contacts (not shown) of the contact pairs can also be connected in parallel, that is e.g. on a common metallic carrier (not shown).

If the transition resistance of the two contacts 25, 26, 27, 28, 29, 30 is different, or one of the two parallel current paths is interfered in another way, a major part or the entire load current flows over the remaining, better conducting or still functioning current path, and the corresponding contact finger 29, 30 as well as the contact pieces 25, 26, 27, 28 are additionally heated.

Figure 3:
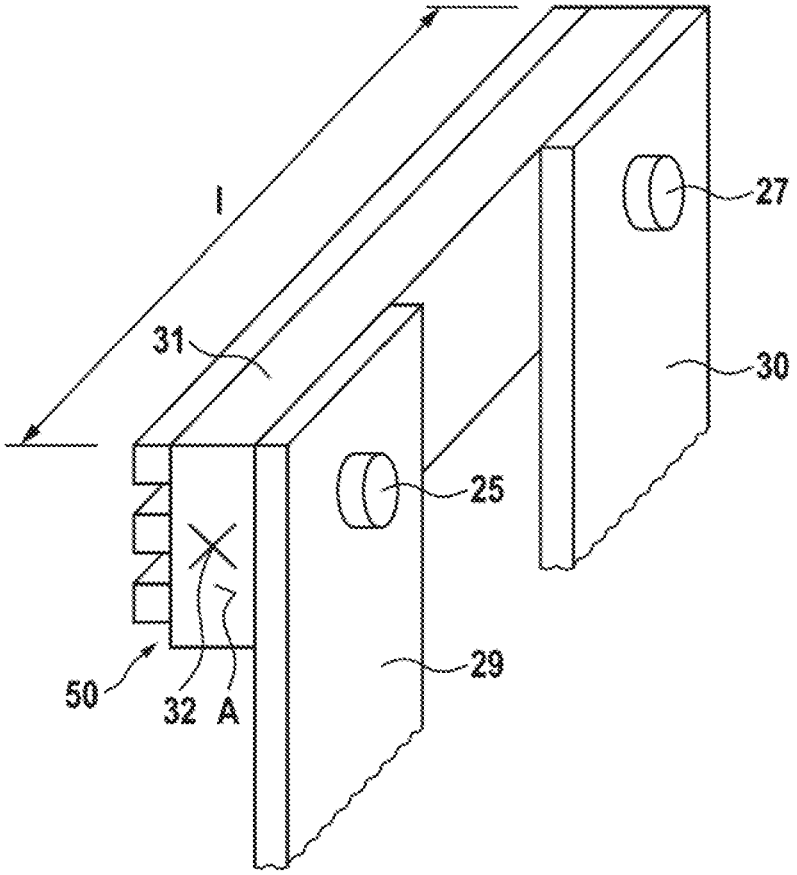
FIG. 3 shows a detail of an embodiment of a relay with thermal bridge.

According to the invention, the two contact fingers 29, 30 are connected to one another preferably in a thermally conductive manner, e.g. by a thermal bridge 31 (cf. FIGS. 3-6) made of a material that is as thermally conductive as best as possible, e.g. copper or aluminum. By means of the thermally conductive bridge 31, the contact finger 29, 30 of the defective current path acts as a heat sink 50 for the elements of the intact current path, whereby the heat can be dissipated in a controlled manner. This is indicated in FIGS. 3 to 5:

FIG. 3 shows a first contact finger 29 with a contact piece 25 which is connected to a second contact finger 30 via a heat sink, which serves as a thermal bridge 31. The thermal bridge 31 has a cross-sectional area A and a length I, measured here between the first contact pieces 25, 27. The cross in the cross-sectional area A symbolizes the rear side of an arrow, which shows the heat flow direction 32 in the event of a failure from the warmer contact finger 29 to the colder contact finger 30. This means that, in the event of failure of the second main contact 20, the entire current flows via the contact pieces pair 25, 26. Due to this fact, the first main contact 19, in particular the first contact piece 25, 26 warms up additionally, and the heat dissipates in the direction of the first contact piece pair 27, 28 via the heat sink 50 or the thermally conductive bridge 31. The second contact spring 30 of the second main contact 20 acts as a heat sink due to the thermally conductive bridge. For improving heat dissipation, the thermally conductive bridge can optionally be provided with cooling ribs, as exemplarily shown.

Figure 3A:
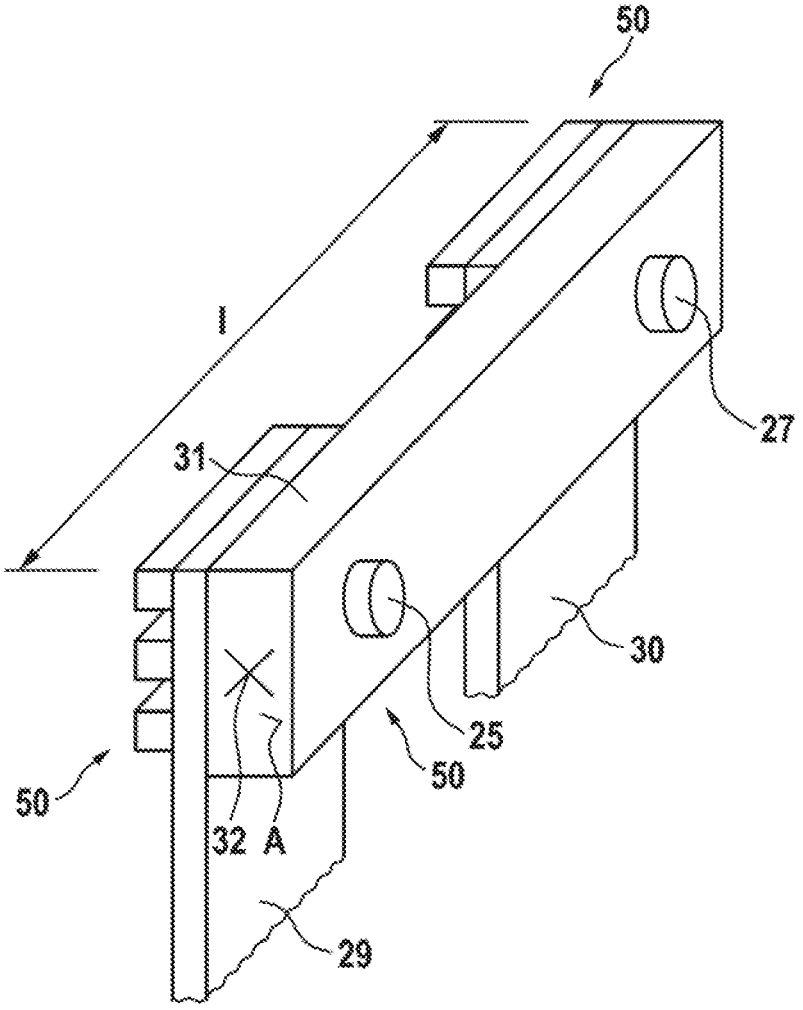
FIG. 3*a* shows a detail of an embodiment of a relay with thermal bridge.

FIG. 3*a* shows an alternative embodiment with the features of FIG. 3. In contrast to the embodiment shown in FIG. 3, the thermal bridge 31 is attached on the side of the first contact pieces 25, 27. This embodiment leads to an additional reduction in the thermal transition resistance between the two first contact fingers 29, 30 and thus to a faster heat dissipation in the event of a failure of one of the main contacts 19, 20. The cooling ribs 50 are optional.

Figure 4:
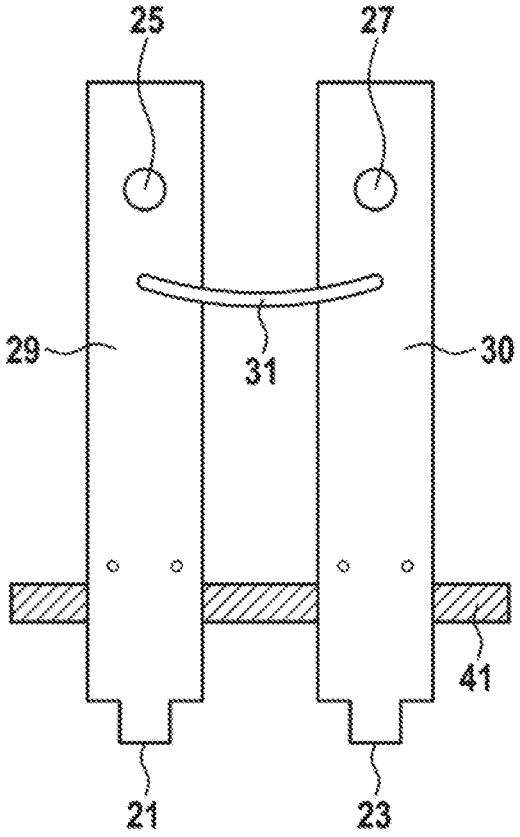
FIG. 4 shows a further view corresponding to FIG. 1 of an embodiment of a relay.
Figure 5:
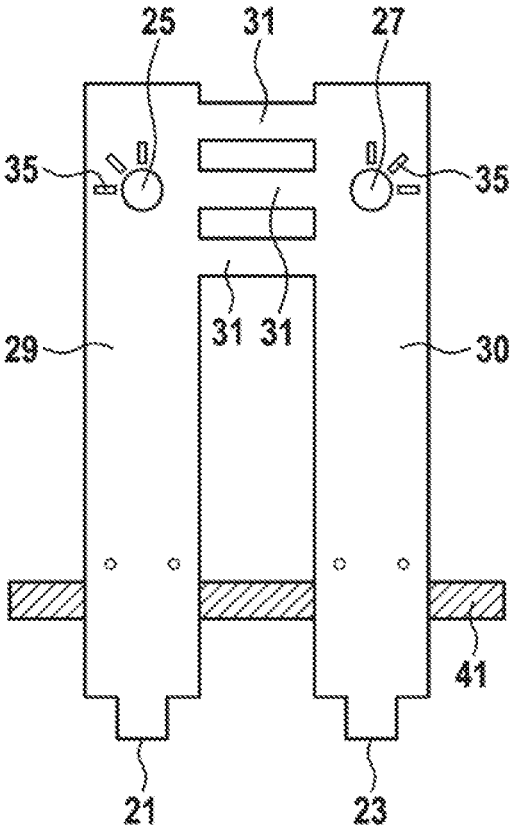
FIG. 5 shows a further view corresponding to FIG. 1 of an embodiment of a relay.

In FIG. 4, the thermal bridge 31 is a metallic braid which thermally connects the two contact fingers 29, 30. The thermal bridge 31 can e.g. be soldered and/or riveted with the contact fingers 29, 30 and/or the contact pieces 25, 27. In contrast to the illustration, the braid is preferably attached at the level of the contact pieces 25, 27 to the contact fingers 29, 30 or directly to the contact pieces 25, 27.

As exemplarily shown in FIG. 5, the thermal bridge 31 has a plurality of thermally conductive connections between the contact fingers 29, 30 which are formed from thermally conductive strips 31, e.g. from a sheet metal. Preferably, the thermally conductive strips 31 are soldered, welded or riveted to the contact fingers 29, 30. Likewise, the strips 31 and the contact fingers 29, 30 can be made in one piece, e.g. punched from a sheet metal. In addition, passage openings 35 can be punched into the upper part of the contact fingers 29, 30 in order to improve the cooling.

Figure 6:
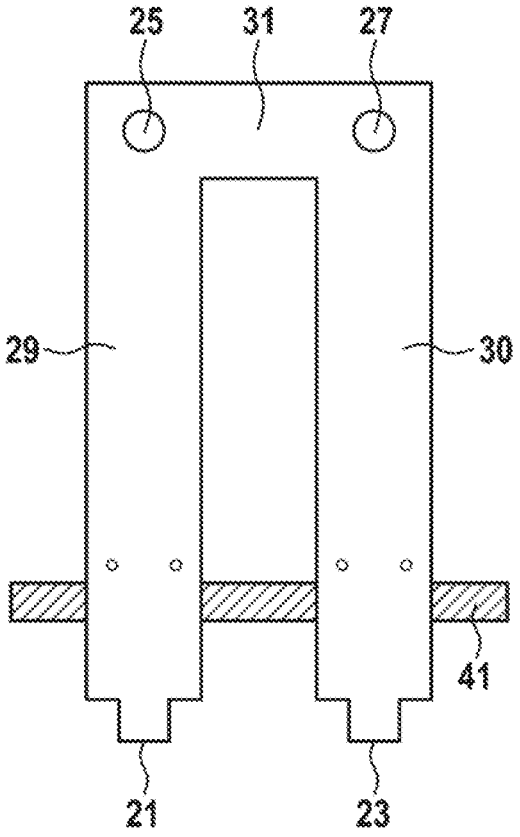
FIG. 6 shows a further view corresponding to FIG. 1 of an embodiment of a relay.

In the embodiment of FIG. 6, the two contact fingers 29, 30 are made in one piece with the thermal bridge 31, e.g. cut or punched from a sheet metal. Also in this example, the thermal bridge 31 is arranged at the level of the contact pieces 25, 27 between the contact fingers 29, 30.

If the defect of one of the two parallel current paths is due to e.g. a defective connection, it is advantageous if the thermal bridge 31 is also electrically conductive, because the current can then again be split by the thermal bridge 31 onto the two contact fingers 29, 30, whereby the overall heat development is reduced (applies for all embodiments). In principle, however, a purely thermal connection of the contact fingers 29, 30 would suffice, i.e. the connection could be electrically insulating (applies for all embodiments).

In the above, the term metal strip has been used as a synonym for "electrical conductors". In the examples shown, the metal strips, which are also called contact fingers 29, 30, have both a mechanical function and an electrical function. These functions can also be separated. In general, the invention can be summarized as at least thermally conductive connection between at least two parallel current paths, for example in a relay, whereby in the event of failure of one of the current paths, the heat generated in the still functioning current path is dissipated via the failed current path. The components of the failed current path act as or are then the heat sink of the still intact current path. The thermal bridge also acts as a heat sink.

It will be appreciated to those skilled in the art having the benefit of this disclosure that this invention is believed to provide a relay and a method for operating the relay. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 Relay
11 A1, first coil connection
12 A2, second coil connection
19 first main contact
20 second main contact
21 first soldering lug of the first main contact
22 second soldering lug of the first main contact
23 first soldering lug of the second main contact
24 second soldering lug of the second main contact
25 first contact piece of the first main contact
26 second contact piece of the first main contact
27 first contact piece of the second main contact
28 second contact piece of the second main contact
29 first contact finger of the first main contact
30 first contact finger of the second main contact
31 thermal bridge
32 heat flow direction
33 first support rail, second contact finger of the first main contact
34 second stop rail, second contact finger of the second main contact
35 passage openings
40 coil with armature
41 carrier
50 heat sink/cooling plate
I length of the heat sink
A cross-sectional area of thermal bridge

The invention claimed is:

1. A method for switching a load current with a relay having at least two main contacts electrically connected in parallel to divide a total load current between said at least two main contacts, wherein a first main contact of the at least two main contacts has a first contact finger carrying a first contact piece of said first main contact, the first contact finger of said first main contact configured to be repositionable to contact a second contact piece of the first main contact to close the first main contact, and to be separated from the second contact piece of the first main contact to open the first main contact, wherein a second main contact of the at least two main contacts has a second contact finger carrying a first contact piece of said second main contact, the second contact finger of said second main contact configured to be repositionable to contact a second contact piece of the second main contact to close the second main contact, and to be separated from the second contact of the second main contact piece to open the second main contact, the method comprising:

repositioning said first and second contact fingers to bring at least one of (i) the first contact piece of the first contact finger and (ii) the first contact piece of the second contact finger in contact with a respectively-corresponding second contact piece, to close the respectively-corresponding main contact from the at least two main contact; and in case of failure of a main contact from the at least two main contact, thermally dissipating at least a part of heat, caused by the total load current, by using the failed main contact as a heat sink for the at least one remaining-operational main contact, wherein the thermally dissipating comprises conducting heat from the at least one remaining-operational main contact from the at least two main contacts to the failed main contact via a heat sink that is thermally connected to both the at least one remaining-operational main contact and the failed main contact, the method further comprising (i) reducing the total load current and (ii) generating output indicia of fault in response to at least one of a. a temperature difference between the at least two main contacts being greater than a first threshold value:

b. a temperature of the at least one of the two main contacts exceeding a second threshold value:

c. having a voltage drop at one of contact fingers of the at least two main contacts rising above a third threshold value: and d. a difference between the values of currents, flowing through contact fingers of the at least two main contacts, exceeding a fourth threshold value.

2. The method according to claim 1, comprising transferring said at least a part of heat from the remaining-operational main contact to the failed main contact through a thermally-conductive bridge that connects said remaining-operational and failed main contacts.

3. A relay configured to switch a load circuit, the relay comprising:

at least two main contacts configured to be operated and electrically connected in parallel, each main contact having a corresponding first movable contact finger that carries a first contact piece, said first contact piece arranged opposite to a complementary second contact piece of said main contact, and at least one actuator in operable connection with first contact pieces, of said at least two main contacts, and configured to bring said first contact pieces into contact with complementary second contact pieces of said at least two main contacts to electrically close the load circuit, wherein the main contacts are configured such that in case of failure of a main contact a total load current is passed via at least one main contact that remains operational, wherein at least two of first contact fingers, of the at least two main contacts, are connected to one another with a thermally-conductive member, wherein said thermally-conductive member configured to conduct at least a portion of heat, that is generated by the at least one main contact that remains operational, to a failed main contact to dissipate said at least a portion of heat at said failed contact, wherein each first contact finger from said first contact fingers has at least one metal strip with first and second ends, the first end being fixed to a carrier and the second end configured to be movable relative to the first end and to carry thereon at least one of said first contact pieces.

4. The relay according to claim 3, wherein the thermally-conductive member is configured as a heat sink of said relay.

5. The relay according to claim 3, wherein the thermally-conductive member is disposed to connect first contact pieces, of the at least two main contacts, to one another.

6. The relay according to claim 3, wherein the thermally-conductive member is disposed to directly mechanically connect first contact pieces of the at least two main contacts.

7. The relay according to claim 3, wherein the thermally-conductive member is disposed to directly connect said first contact fingers to one another at a level oft first contact pieces.

8. A relay configured to switch a load circuit, the relay comprising:

at least two main contacts configured to be operated and electrically connected in parallel, each main contact having a corresponding first movable contact finger that carries a first contact piece, said first contact piece arranged opposite to a complementary second contact piece of said main contact, and at least one actuator in operable connection with first contact pieces, of said at least two main contacts, and configured to bring said first contact pieces into contact with complementary second contact pieces of said at least two main contacts to electrically close the load circuit, wherein the main contacts are configured such that in case of failure of a main contact a total load current is passed via at least one main contact that remains operational, wherein at least two of first contact fingers, of the at least two main contacts, are connected to one another with a thermally-conductive member, wherein said thermally-conductive member configured to conduct at least a portion of heat, that is generated by the at least one main contact that remains operational, to a failed main contact to dissipate said at least a portion of heat at said failed contact, and wherein a cross-section A of the thermally conductive member satisfies a condition of $$A \geq \frac{P_v l}{\Delta T \lambda},$$

wherein Pv is a value of power loss at a main contact, from the at least two main contacts, at a nominal current; l is a length of the thermally conductive member between the at least two main contacts; λ is a value of specific thermal conductivity of the thermally-conductive member; and ΔT is a maximum value of permissible temperature difference between first and second ends of the thermally conductive member.

9. The relay according to claim 8, wherein the thermally-conductive member is configured as a heat sink of said relay.

10. The relay according to claim 8, wherein the thermally-conductive member is disposed to connect first contact pieces, of the at least two main contacts, to one another.

11. The relay according to claim 8, wherein the thermally-conductive member is disposed to directly mechanically connect first contact pieces of the at least two main contacts.

12. The relay according to claim 8, wherein the thermally-conductive member is disposed to directly connect said first contact fingers to one another at a level of the first contact pieces.

13. The relay according to one claim 8, wherein each first contact finger from said first contact fingers has at least one metal strip with first and second ends, the first end being fixed to a carrier and the second end configured to be movable relative to the first end and to carry thereon at least one of said first contact pieces.

* * * * *